US010699513B2

(12) United States Patent
Jeon

(10) Patent No.: US 10,699,513 B2
(45) Date of Patent: Jun. 30, 2020

(54) BALLOON VENDING MACHINE AND BALLOON TO BE SOLD THEREBY

(71) Applicant: RISING ENTERTAINMENT CO., LTD., Tokyo (JP)

(72) Inventor: Juntak Jeon, Tokyo (JP)

(73) Assignee: RISING ENTERTAINMENT CO., LTD., Tokyo (JP)

( * ) Notice: Subject to any disclaimer, the term of this patent is extended or adjusted under 35 U.S.C. 154(b) by 0 days.

(21) Appl. No.: 15/548,177

(22) PCT Filed: Feb. 2, 2016

(86) PCT No.: PCT/JP2016/053023

§ 371 (c)(1),
(2) Date: Aug. 2, 2017

(87) PCT Pub. No.: WO2016/125778

PCT Pub. Date: Aug. 11, 2016

(65) Prior Publication Data

US 2018/0025574 A1 Jan. 25, 2018

(30) Foreign Application Priority Data

Feb. 3, 2015 (JP) ..... 2015-000476 U

(51) Int. Cl.
*A63H 27/10* (2006.01)
*G07F 11/00* (2006.01)
(Continued)

(52) U.S. Cl.
CPC ..... *G07F 17/32* (2013.01); *A63H 27/10* (2013.01); *G07F 9/10* (2013.01); *G07F 11/00* (2013.01);
(Continued)

(58) Field of Classification Search
CPC ..... G07F 11/00; G07F 9/10; A63H 27/10; A63H 2027/1033; A63H 2027/1083
See application file for complete search history.

(56) References Cited

U.S. PATENT DOCUMENTS 3,380,490 A * 4/1968 Ellenberg ..... G07F 11/00 141/167
3,536,110 A * 10/1970 West ..... G07F 13/02 141/137
(Continued)

FOREIGN PATENT DOCUMENTS

JP 6-210986 A 8/1994
JP 6-337985 A 12/1994
(Continued)

OTHER PUBLICATIONS

US 5,338,241 A, 08/1994, Van Dyke et al. (withdrawn)

*Primary Examiner* — Eugene L Kim
*Assistant Examiner* — Alyssa M Hylinski
(74) *Attorney, Agent, or Firm* — Birch, Stewart, Kolasch & Birch, LLP

(57) ABSTRACT

Provided are a balloon vending machine that can provide an impactful state where the balloon purchaser can participate in a production process of a balloon and the balloon body expands to break and open the balloon case, and further that can reuse the balloon case as a handle, and a balloon to be sold by the balloon vending machine. Below the gas injection part 26 of the balloon vending machine 10, a gas injection device is disposed that expands the balloon body 24 stored in a folded state in the balloon case. The gas injection device is mounted with a gas injection nozzle. Further, a valve lock plate is disposed in the nozzle mover. The balloon includes a balloon body, a balloon case storing
(Continued)

the balloon body, a balloon valve, and a string connecting the balloon body with the balloon case.

5 Claims, 15 Drawing Sheets

(51) Int. Cl.
*G07F 17/32* (2006.01)
*G07F 9/10* (2006.01)

(52) U.S. Cl.
CPC ..... *A63H 2027/1033* (2013.01); *A63H 2027/1041* (2013.01); *A63H 2027/1083* (2013.01)

(56) References Cited

U.S. PATENT DOCUMENTS 3,911,974 A * 10/1975 Kuykendall ..... F17C 7/00 141/94
4,088,161 A * 5/1978 Ikemoto ..... G07F 17/06 141/167
5,083,771 A * 1/1992 Tyner ..... A63H 27/10 116/DIG. 9
5,399,122 A * 3/1995 Slater ..... A63H 27/10 116/210
5,573,437 A * 11/1996 Van Dyke ..... B42D 15/045 446/176
6,634,394 B1 * 10/2003 Nelson ..... A63H 27/10 141/114
2007/0084878 A1 * 4/2007 Handa ..... A63H 27/10 221/303
2007/0249259 A1 * 10/2007 Pham ..... A63H 5/00 446/224

FOREIGN PATENT DOCUMENTS

JP 2002-334371 A 11/2002
JP 2002334371 A * 11/2002

* cited by examiner

BALLOON VENDING MACHINE AND BALLOON TO BE SOLD THEREBY

TECHNICAL FIELD

The present invention relates to a balloon vending machine mainly installed at a place where many children go play, such as a theme park, an amusement park, a shopping mall, and a game arcade, and to a balloon to be sold at the balloon vending machine.

BACKGROUND ART

A balloon vending machine is proposed that is installed at a place where many children go play, such as a theme park, an amusement park, a shopping mall, and a game arcade so as to sell a balloon. When money is input, the balloon vending machine injects helium gas or the like into the balloon to expand the balloon, thereby automatically providing the expanded balloon (Patent Literature 1).

Therefore, since a balloon purchaser cannot see a state where the balloon is getting expanded, the balloon purchaser only waits in front of the balloon vending machine while the balloon is getting expanded, which bores the balloon purchaser. Thus, the balloon vending machine is provided that allows the balloon purchaser to observe the state where the purchased balloon is gradually getting expanded by injection of helium gas or the like (Patent Literature 2).

With this type of the balloon vending machine, when the balloon is set in a gas injection device, it is possible to observe the state where the balloon is gradually getting expanded by injection of helium gas or the like into the balloon from a gas bomb built in the balloon vending machine. However, since the balloon purchaser can expect in advance the state where the balloon is gradually getting expanded by injection of helium gas or the like, this type of the balloon vending machine lacks originality, and cannot impact the balloon purchaser.

Further, there is an inconvenience in which, since the balloon to be sold does not have a handle provided at a lower end part of a string, it is hard for the balloon purchaser to hold the string. If his/her fingers holding the string lose a force inadvertently, the balloon goes up high in the sky because of the helium gas or the like, and thus the purchased balloon is lost. Furthermore, if the balloon is sold in a state stored in a balloon case by the balloon vending machine, after the balloon is taken out from the balloon case, the balloon case will be unnecessary. Therefore, the garbage box is required to discard the balloon case therein.

CITATION LIST

Patent Literature

PTL 1: Japanese Patent Laid-Open No. H06-337985
PTL 2: Japanese Patent Laid-Open No. 2002-334371

SUMMARY OF INVENTION

Technical Problem

In consideration of the above described facts, the present invention is implemented to provide the balloon vending machine that allows the balloon purchaser to participate in a part of a production process of the balloon, enables providing the state with originality and impact where the balloon body is expanded to break and open the balloon case storing the balloon body, and allows the balloon case to be reused as the handle when the balloon purchaser holds the balloon, and the balloon sold at the balloon vending machine.

Solution to Problem

To attain a purpose described above, a balloon vending machine of the present invention includes: a table plate provided at front face of a machine body; a balloon case inserting port which is formed passing through the table plate, and into which a balloon case storing a balloon body is inserted; a lock mechanism configured to lock a balloon valve into which gas is injected when the balloon case is inserted into the balloon case inserting port; a gas injection nozzle that is disposed below the table plate and is capable of connecting to the balloon valve by vertical movement; and a control section configured to control movement of the gas injection nozzle and injection of the gas into the balloon body, wherein the control section moves the balloon case together with the gas injection nozzle upward and starts injection of the gas into the balloon body, when having detected that the balloon case has been projected upward from the table plate.

Advantageous Effects of the Invention

The present invention has an excellent effect in which the balloon purchaser, when expanding the balloon body, inserts the gas injection nozzle into the balloon valve, and thus can participate in a part of process of producing the balloon and can enjoy producing the balloon.

The present invention has an excellent effect in which since, when the balloon body expands, the balloon case storing the balloon body opens so as to be broken, the balloon purchaser can observe an impactful state where the balloon case is dynamically broken to be opened, in addition to simply observing the state where the balloon body is getting expanded.

The present invention allows the balloon purchaser to observe the impactful state where the balloon case is dynamically broken to be opened, and thus has an excellent effect in which the balloon purchaser does not get bored during a waiting time until the balloon body is expanded.

The present invention allows the balloon case to be used as the handle when the balloon is held, and thus has an excellent effect in which it is possible to prevent the balloon from going up high in the sky and flying away.

The present invention allows the balloon case to be reused as the handle, and thus has an excellent effect in which the balloon case is prevented from being discarded as garbage, and a garbage box for discarding the balloon case does not need to be installed in the vicinity of the balloon vending machine.

DESCRIPTION OF EMBODIMENTS

First Embodiment

FIGS. 1 to 12 illustrate an embodiment of a balloon vending machine according to the present invention and a balloon to be sold thereby.

Configuration of Balloon Vending Machine According to First Embodiment

Figure 1:
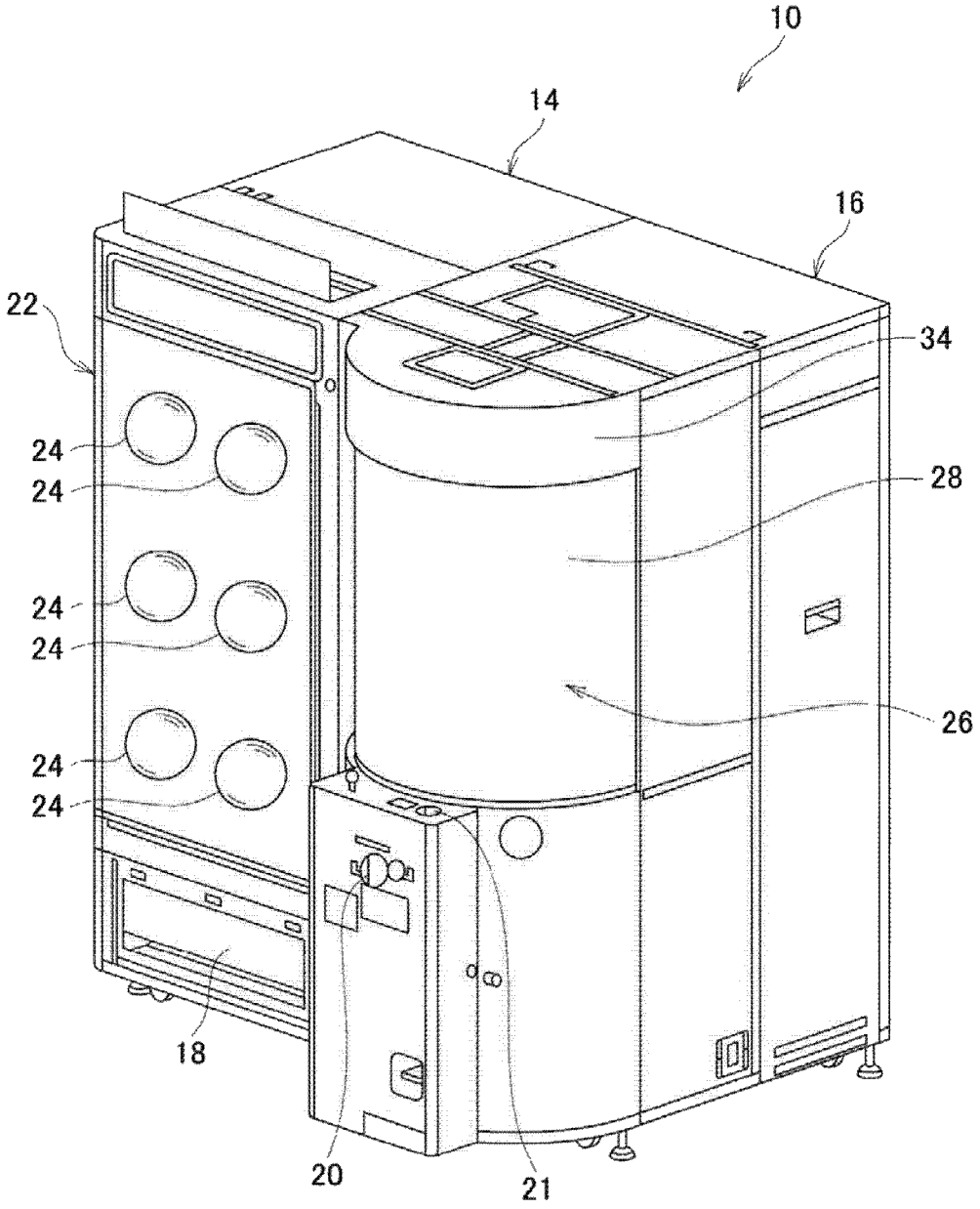
FIG. 1 is an entire perspective view of a balloon vending machine according to a first embodiment.
Figure 2:
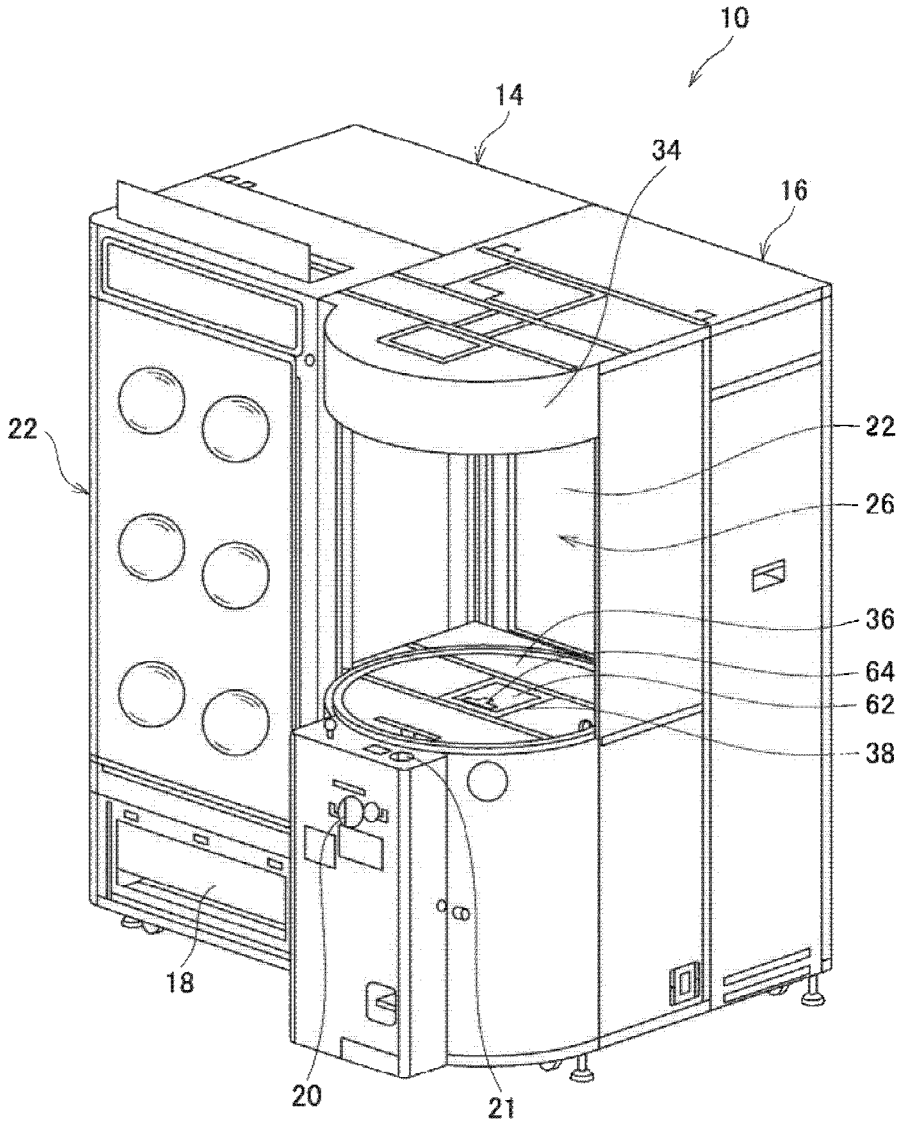
FIG. 2 is an entire perspective view of the balloon vending machine according to the first embodiment with its door of gas injection part opened.

FIGS. 1 and 2 illustrate a balloon vending machine 10 applied to a balloon vending machine and a balloon to be sold thereby. At one side part of the balloon vending machine 10, a balloon stock part 14 that stocks a balloon 12 (refer to FIG. 10) to be sold at the balloon vending machine 10 is provided. At another side part of the balloon vending machine 10, a storage part for machine body 16 is continuously provided.

At a lower front face of the balloon stock part 14, a balloon discharging opening 18 is formed to be opened. When money for purchasing a balloon is input into a coin inserting slot 20 formed at front face of the storage part for machine body 16 and a selection determination button 21 is pressed, the balloon 12 stored in the balloon stock part 14 is discharged to the balloon discharging opening 18.

From a lower intermediate part of the front face of the balloon stock part 14 to an upper part thereof in a vertical direction, a balloon sample case part 22 is provided. The balloon sample case part 22 is covered with a transparent acrylic plate, so that a balloon body 24 of the balloon 12 displayed in the balloon sample case part 22 in an expanded state can be observed. Note that the balloon sample case part 22 may be covered with a glass plate in place of the acrylic plate.

In the balloon sample case part 22, a plurality of (six in the embodiment) balloon bodies 24 having a traditional spherical shape or being imitated and designed animation characters, animals and the like, that can be purchased at the balloon vending machine 10 is displayed as samples in the expanded state.

From an intermediate part of the front face of the storage part for machine body 16 to the upper part thereof in the vertical direction, a gas injection part 26 in a chamber-like shape is provided for injecting the gas into the balloon body 24 of the balloon 12 to expand the balloon body 24. As illustrated in FIG. 1, the front face of the gas injection part 26 is covered with a door of gas injection part 28 having a circular arc shape in planar view and formed with the transparent acrylic plate, so that a state inside the gas injection part 26 can be observed from outside. Note that, as described above, the door of gas injection part 28 is transparent. However, FIG. 1 is illustrated such that an inside of the gas injection part 26 is not visible to clarify the existence of the door of gas injection part 28.

The door of gas injection part 28 is configured to open or close an entrance of the gas injection part 26 by rotating in a circumferential direction with a door motor (not illustrated). Therefore, when the door of gas injection part 28 is opened, the balloon 12 with its balloon body 24 stored in a balloon case 30 (refer to FIG. 10) can be put in the gas injection part 26, or the balloon 12 with its balloon body 24 expanded can be taken out.

As illustrated in FIG. 2, at a back face of the gas injection part 26, a display monitor 32 is provided. The display monitor 32 displays the balloon bodies 24 of all the balloons 12 to be sold at the balloon vending machine 10, including the balloon body 24 that cannot be displayed because of lack of space in the balloon sample case part 22. Therefore, the balloon purchaser observes a plurality of balloon bodies 24 displayed on the display monitor 32, and can select the balloon 12 with design desired to be purchased. Further, light (not illustrated) is mounted on an internal face of a roof part 34 of the gas injection part 26, and an inside part of the gas injection part 26 can be lit in an arbitrary color.

Figure 3:
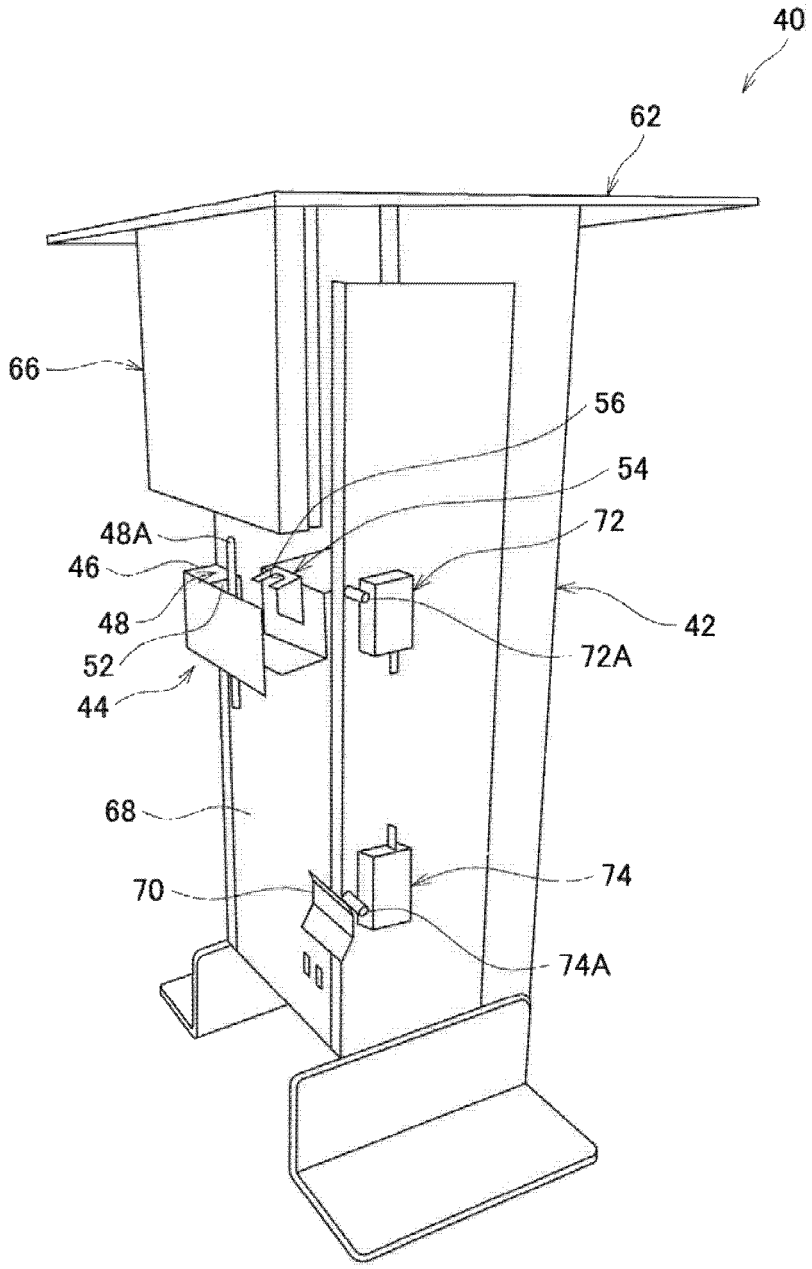
FIG. 3 is a perspective view of the gas injection device of the balloon vending machine according to the first embodiment.
Figure 4:
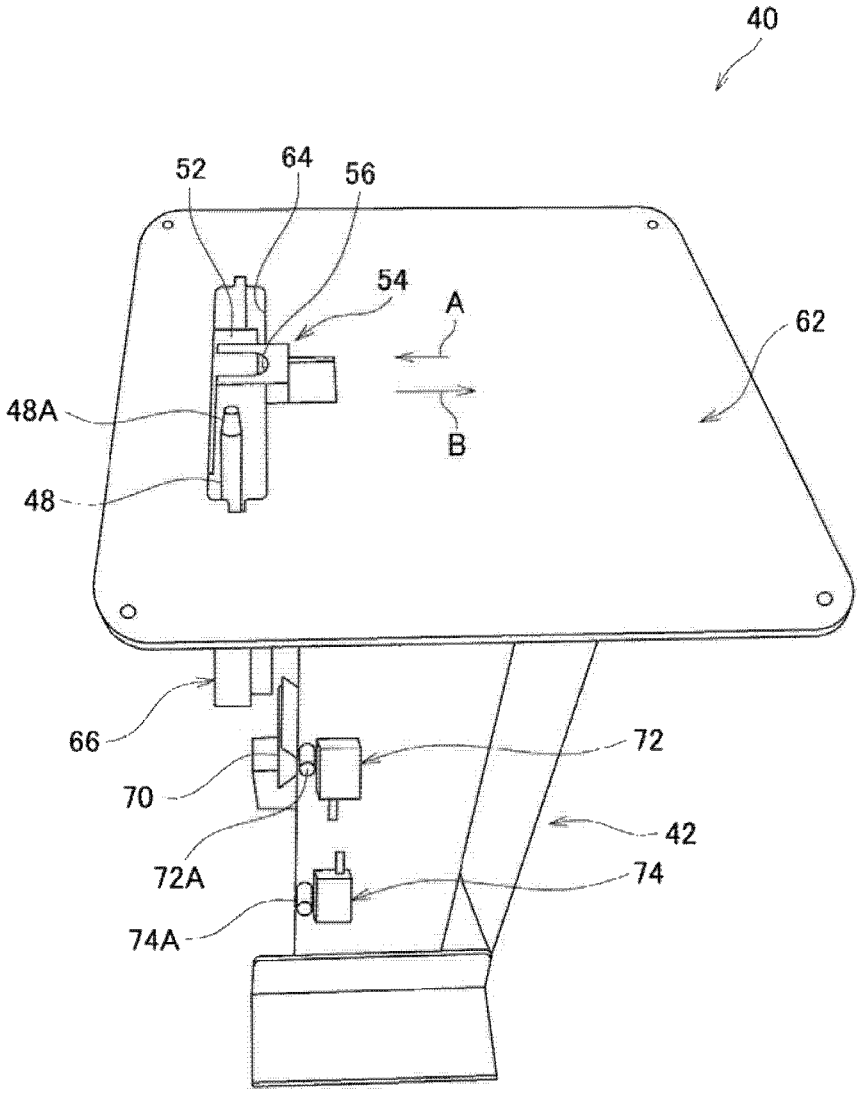
FIG. 4 is a perspective view of the gas injection device of the balloon vending machine according to the first embodiment viewed from above.

An opening of bottom face plate 38 is formed by passing through a bottom face plate 36 of the gas injection part 26. Below the gas injection part 26, a gas injection device 40 (refer to FIGS. 3 and 4) that expands the balloon body 24 stored in the balloon case 30 in a folded state is arranged. As illustrated in FIGS. 3 and 4, inside a casing 42 of the gas injection device 40, a rotational shaft (not illustrated) formed with a spring in the vertical direction is vertically arranged. A nozzle mover 44 is mounted movably in the vertical direction on the rotational shaft. The nozzle mover 44 moves upward when the rotational shaft performs positive rotation, and the nozzle mover 44 moves downward when the rotational shaft performs reverse rotation.

As illustrated in FIG. 3, a leading end part of the nozzle mover 44 is provided to protrude at front face side of the casing 42. A nozzle mounting part 46 is formed at the leading end part of the nozzle mover 44, and a gas injection nozzle 48 is vertically arranged in the vertical direction at the nozzle mounting part 46. At an upper end part of the gas injection nozzle 48, a tapered part 48A is formed to be easily inserted into the balloon valve (described below), so as to be removably mounted to the balloon body 24. As described above, the gas injection nozzle 48 is arranged below a table plate 62, and can be connected to a balloon valve 76 by vertical movement.

Figure 5:
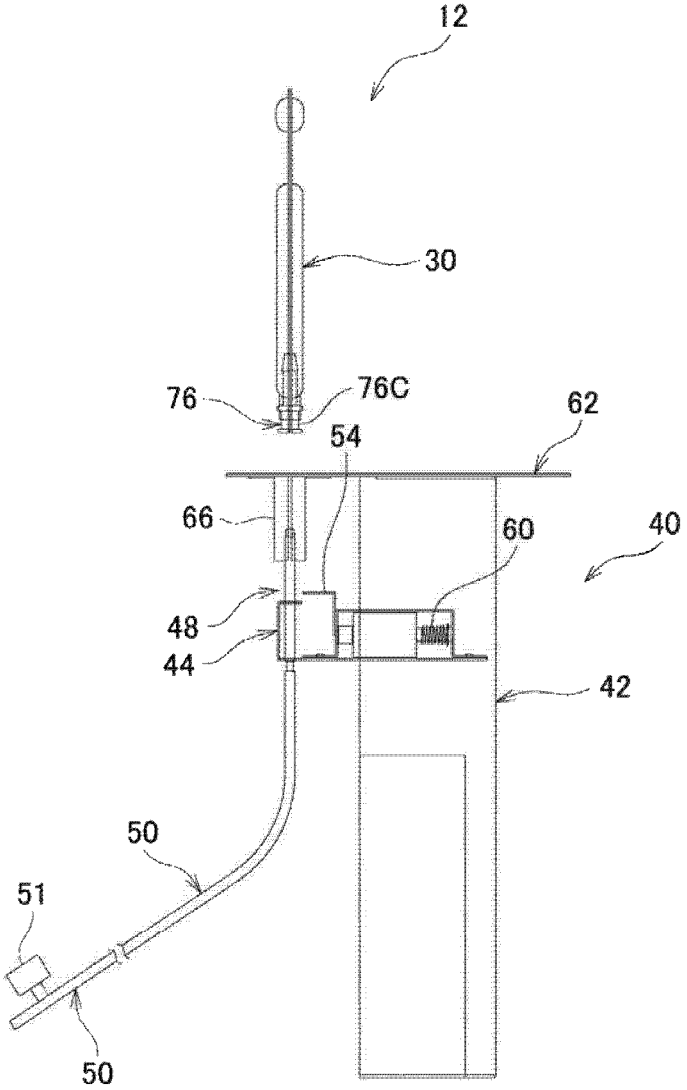
FIG. 5 is a schematic explanatory diagram illustrating procedure of expanding a balloon body stored in a balloon case by the gas injection device of the balloon vending machine according to the first embodiment.

As illustrated in FIG. 5, a leading end part of a gas hose 50 is connected to a lower end part of the gas injection nozzle 48. A basic end part of the gas hose 50 is connected to a gas bomb (not illustrated) built in the storage part for machine body 16. Note that, according to the embodiment, helium gas is used as the gas to be injected into the balloon body 24 of the balloon 12. Therefore, the helium gas is filled in the gas bomb. Further, at an intermediate part of the gas hose 50, a gas injection sensor 51 is provided. The gas injection sensor 51 perceives the helium gas when a certain amount of helium gas is injected into the balloon body 24.

As illustrated in FIG. 3, a first switch 52 is mounted at the nozzle mounting part 46. As illustrated in FIG. 4, a valve lock plate 54 is slidably arranged in the nozzle mover 44 in a forward direction (an arrow A direction in FIG. 4) and a backward direction (an arrow B direction in FIG. 4). As described above, the nozzle mover 44 includes the valve lock plate 54 provided movably in a front and back direction. A leading end part of the valve lock plate 54 is cut to form an opening part of lock 56. Note that, movement of the valve lock plate 54 in the front and back direction is controlled by the first switch 52. As described above, the valve lock plate 54 includes the opening part of lock 56 formed to lock the balloon valve 76.

As illustrated in FIG. 5, a solenoid 60 is arranged that slides the valve lock plate 54 in the front and back directions (a right and left directions in FIG. 5) in the nozzle mover 44. As illustrated, at an upper end face of the casing 42 of the gas injection device 40, the flat table plate 62 is provided. The table plate 62 is designed to be fitted into the opening of bottom face plate 38 of the gas injection part 26 (refer to FIG. 2). A balloon case inserting port 64 in an inverted T shape is formed by passing through the table plate 62.

As illustrated in FIG. 3, on a lower face at a front side of the table plate 62, a guide cylinder for balloon case 66 is fixed in a hung state so as to enclose the balloon case inserting port 64. At a back face of the guide cylinder of balloon case 66, an open part is formed, so that the nozzle mover 44 can vertically move in the guide cylinder for balloon case 66 without being disturbed by the guide cylinder for balloon case 66. Below the nozzle mover 44, a switch activator mounting plate 68 is fixed. Therefore, the switch activator mounting plate 68 is vertically moved along the nozzle mover 44. Further, at one side of the switch activator mounting plate 68, a switch activator 70 is fixed.

At a side face of the casing 42, a second switch 72 and a third switch 74 are provided with space in the vertical direction. The second switch 72 and the third switch 74 control vertical movement of the nozzle mover 44. The second switch 72 is formed with a contact part 72A with which the switch activator 70 comes into contact to press the contact part 72A. Further, the third switch 74 is also formed with a contact part 74A with which the switch activator 70 comes into contact to press the contact part 74A. The contact part 72A and the contact part 74A are pressed by the switch activator 70, so that the second switch 72 and the third switch 74 can be switched between on and off.

The control section includes a CPU, a memory and a peripheral connection part, and controls each part depending on purchaser's operations, such as on and off of each switch. For example, the control section controls movement of the gas injection nozzle 48 and injection of the gas into the balloon body 24. Further, the control section moves the balloon case 30 together with the gas injection nozzle 48 upward, and starts injection of the gas into the balloon body 24, when having detected that the balloon case has been projected upward from the table plate 62. Furthermore, the control section finishes gas injection when gas pressure becomes constant.

Configuration of Balloon

Figure 10:
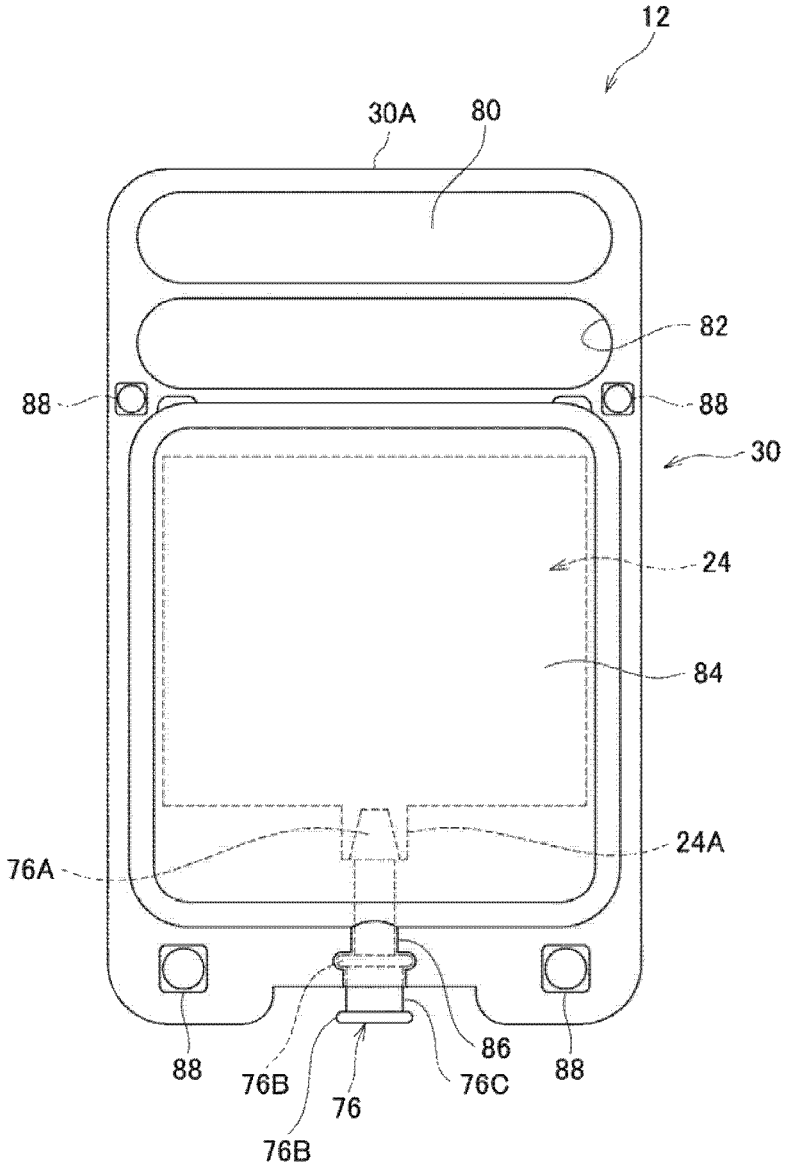
FIG. 10 is a front view of a balloon to be sold at the balloon vending machine according to the first embodiment.

FIG. 10 illustrates the balloon 12 to be sold at the balloon vending machine 10. The balloon 12 includes the balloon body 24 made of vinyl, the balloon case 30 storing the balloon body 24 in the folded state, the balloon valve 76 made of synthetic resin fitted into a gas injection cylinder part 24A of the balloon body 24, and a string 78 (refer to FIG. 12) connecting the balloon body 24 with the balloon case 30.

A non-return valve (not illustrated) is built in the balloon body 24 near the gas injection cylinder part 24A formed in the balloon body 24, so that the injected helium gas is prevented from leaking from the balloon body 24. The balloon case 30 is formed of a transparent blister case. A handle 80 to be held with a palm, a finger inserting part 82 through which fingers pass, a storage part for balloon body 84 storing the folded balloon body 24, a valve inserting part 86 through which the balloon valve 76 passes, and a casing piece engagement part 88 are integrally formed in the balloon case 30.

Figure 11:
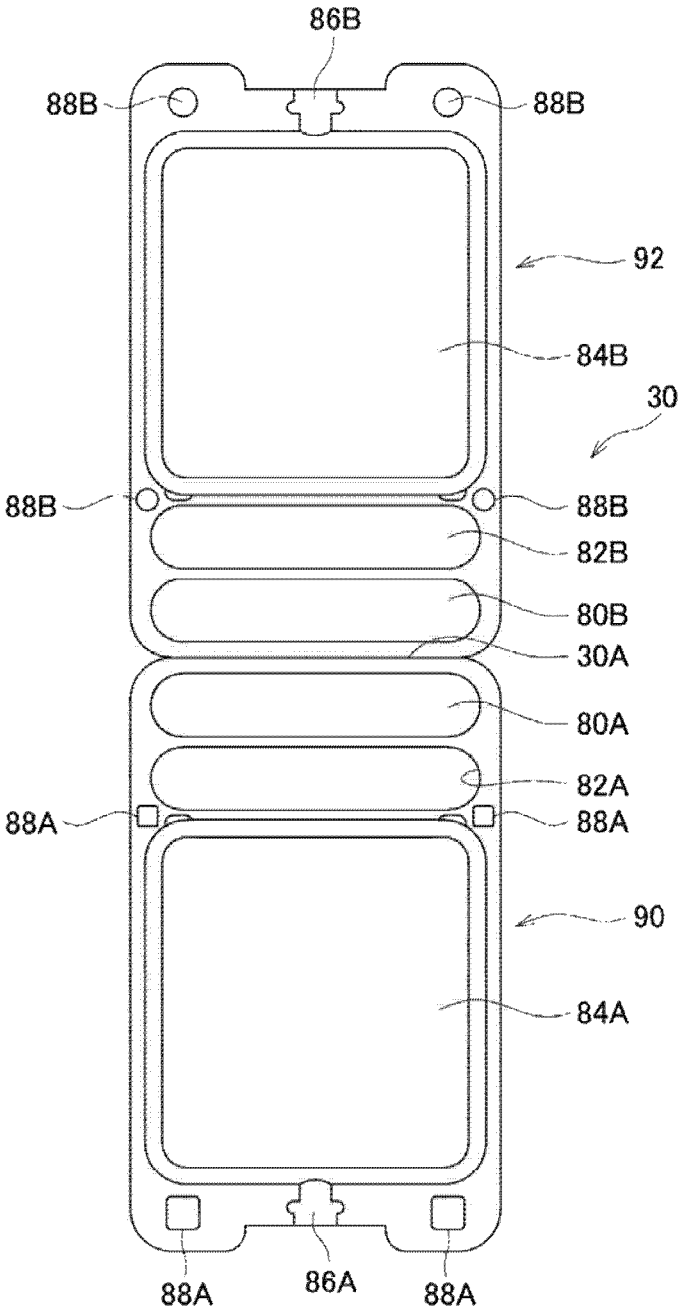
FIG. 11 is an exploded view of the balloon case of the balloon to be sold at the balloon vending machine according to the first embodiment.

As illustrated in FIG. 11, the balloon case 30 includes a first casing piece 90 and a second casing piece 92 via a center folding line 30A. The first casing piece 90 is formed with a first forming part of handle 80A that forms the handle 80, a finger insertion first hole part 82A that forms the finger inserting part 82, a first forming part of balloon storage part 84A that forms the storage part for balloon body 84, a first forming part of valve inserting part 86A that forms the valve inserting part 86, and first parts of engagement part 88A, 88A, 88A, and 88A in a recessed state that form the casing piece engagement part 88.

Further, the second casing piece 92 is formed with a second forming part of handle 80B that forms the handle 80 corresponding to the first forming part of handle 80A, a finger insertion second hole part 82B that forms the finger inserting part 82 corresponding to the finger insertion first hole part 82A, a second forming part of balloon storage part 84B that forms the storage part for balloon body 84 corresponding to the first forming part of balloon storage part 84A, a second forming part of valve inserting part 86B that forms the valve inserting part 86 corresponding to the first forming part of valve inserting part 86A, and second parts of engagement part 88B, 88B, 88B, and 88B in a protruding state that form the casing piece engagement part 88 corresponding to the first part of engagement part 88A. As described above, the balloon case 30 includes the valve inserting part 86 that fixes the balloon valve 76 in an inserted state when the balloon case 30 is closed.

As illustrated in FIG. 10, at the leading end part of the balloon valve 76, a balloon inserted part 76A in a tapered state is formed. Further, outside the base-side end part of the balloon valve 76, a lock plate engagement recessed part 76C is formed between bulging parts 76B and 76B. An outer diameter of the bulging parts 76B and 76B is formed to have a larger dimension than a width dimension of the lock 56. However, the outer diameter of an opening part of lock plate engagement recessed part 76C is formed to have a smaller dimension than a width dimension of the opening part of lock 56. Therefore, when the balloon valve 76 gets into the opening part of lock 56 of the valve lock plate 54, the balloon valve 76 is locked with the valve lock plate 54.

Figure 12:
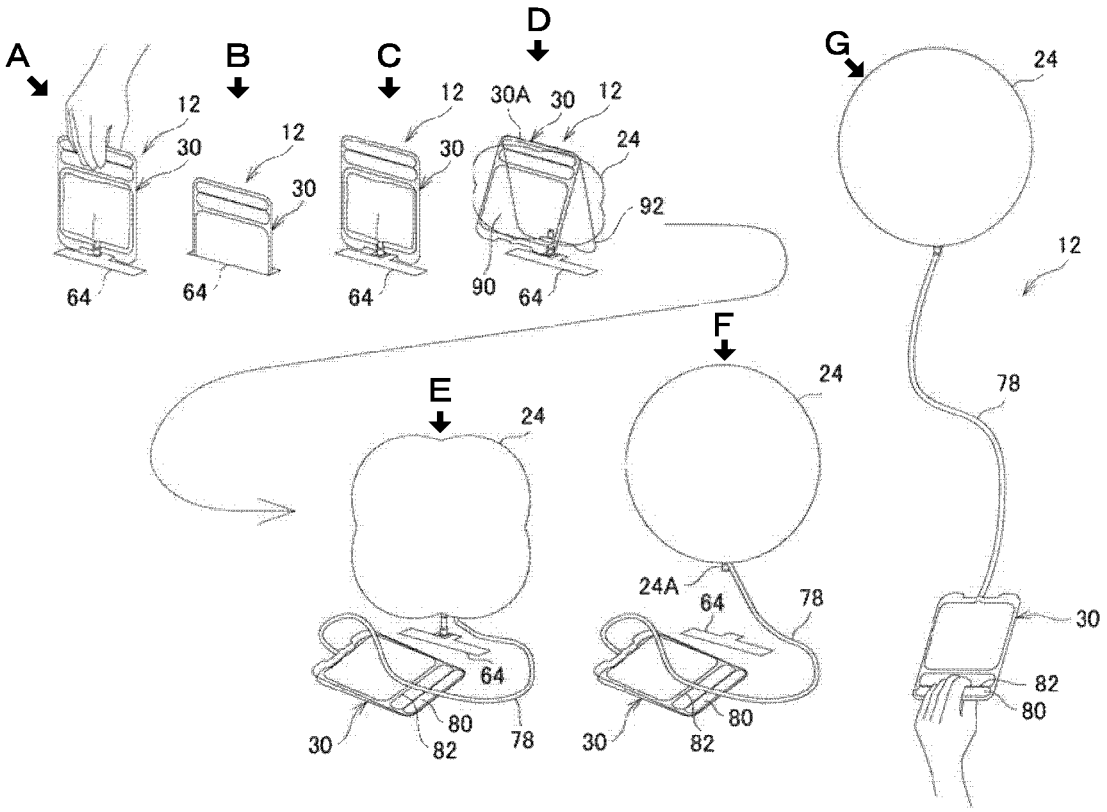
FIG. 12 is a schematic explanatory diagram illustrating a state where the balloon case storing the balloon body to be sold at the balloon vending machine according to the first embodiment is going to be opened.

As illustrated in FIG. 12, a one end part 78A of the string 78 is connected to the balloon body 24 of the balloon 12. The other end part 78B of the string is connected to an internal face of the balloon storage part 84 of the balloon case 30 storing the balloon body 24.

Actions of Balloon Vending Machine According to First Embodiment and Balloon

Next, actions of the balloon vending machine according to the embodiment and the balloon to be sold thereby will be described. When the balloon 12 is purchased at the balloon vending machine 10, the balloon purchaser observes the plurality of balloon bodies 24 displayed on the display monitor 32 of the balloon vending machine 10, and determines the balloon 12 with design desired to be purchased.

Then, when the balloon purchaser inputs the money into the coin inserting slot 20 and presses the selection determination button 21 of the balloon 12 to be purchased, the selected balloon 12 is discharged from the balloon discharging opening 18. Further, in the gas injection part 26 of the balloon vending machine 10, a door opening and closing motor is driven to open the door of gas injection part 28. The balloon purchaser puts the balloon case 30 of the balloon 12 discharged from the balloon discharging opening 18 inside the gas injection part 26, pushes the balloon case 30 into the balloon case inserting port 64 (refer to A state of FIG. 12), and further pushes the balloon case 30 more inside therein to insert the gas injection nozzle 48 into the balloon valve 76 (refer to B state of FIG. 12).

The balloon purchaser performs a work for pushing the balloon case 30 into the balloon case inserting port 64 and inserting the gas injection nozzle 48 into the balloon valve 76, so that the balloon purchaser can realize participation in apart of process of producing a balloon and also enjoy producing the balloon. By pushing the balloon case 30 inside, the first switch 52 of the gas injection device 40 is pressed by the balloon case 30 to turn on the first switch 52, and the solenoid 60 is set in an on state.

Figure 6:
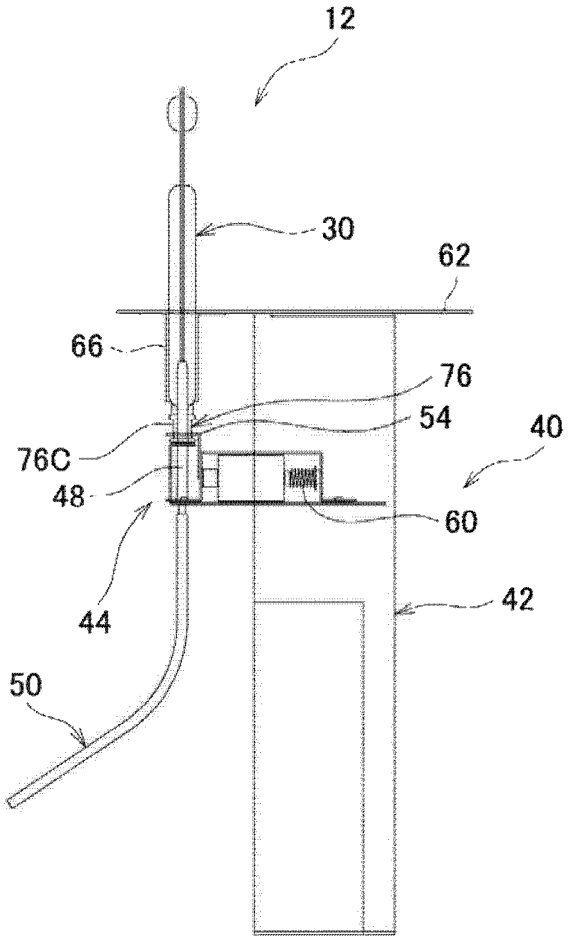
FIG. 6 is a schematic explanatory diagram illustrating the procedure of expanding the balloon body stored in the balloon case by the gas injection device of the balloon vending machine according to the first embodiment.
Figure 7:
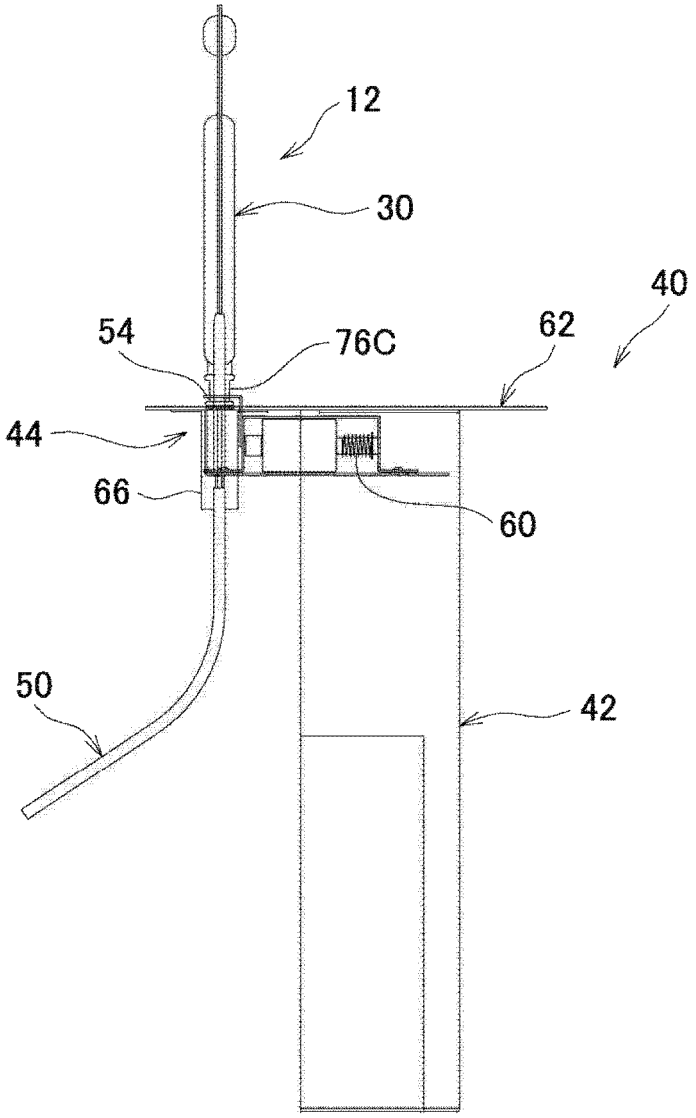
FIG. 7 is a schematic explanatory diagram illustrating the procedure of expanding the balloon body stored in the balloon case by the gas injection device of the balloon vending machine according to the first embodiment.

With the solenoid 60, the valve lock plate 54 goes forward in an arrow A direction illustrated in FIG. 4, and the opening part of lock 56 of the valve lock plate 54 locks a lock plate engagement recessed part 76C of the balloon valve 76 (refer to FIG. 6). Note that the solenoid 60 keeps the on state at this time. As described above, the valve lock plate 54 and the solenoid 60 that moves the valve lock plate 54 constitute a lock mechanism. The lock mechanism locks the balloon valve for injecting the gas when the balloon case is inserted into the balloon case inserting port.

On the other hand, the rotational shaft performs a positive rotation to move the nozzle mover 44 upward, the switch activator 70 of the switch activator mounting plate 68 moved upward with the nozzle mover 44 presses the contact part 72A of the second switch 72 to turn on the second switch 72. With this arrangement, the rotational shaft stops the positive rotation to stop the nozzle mover 44 (refer to FIG. 7).

Figure 8:
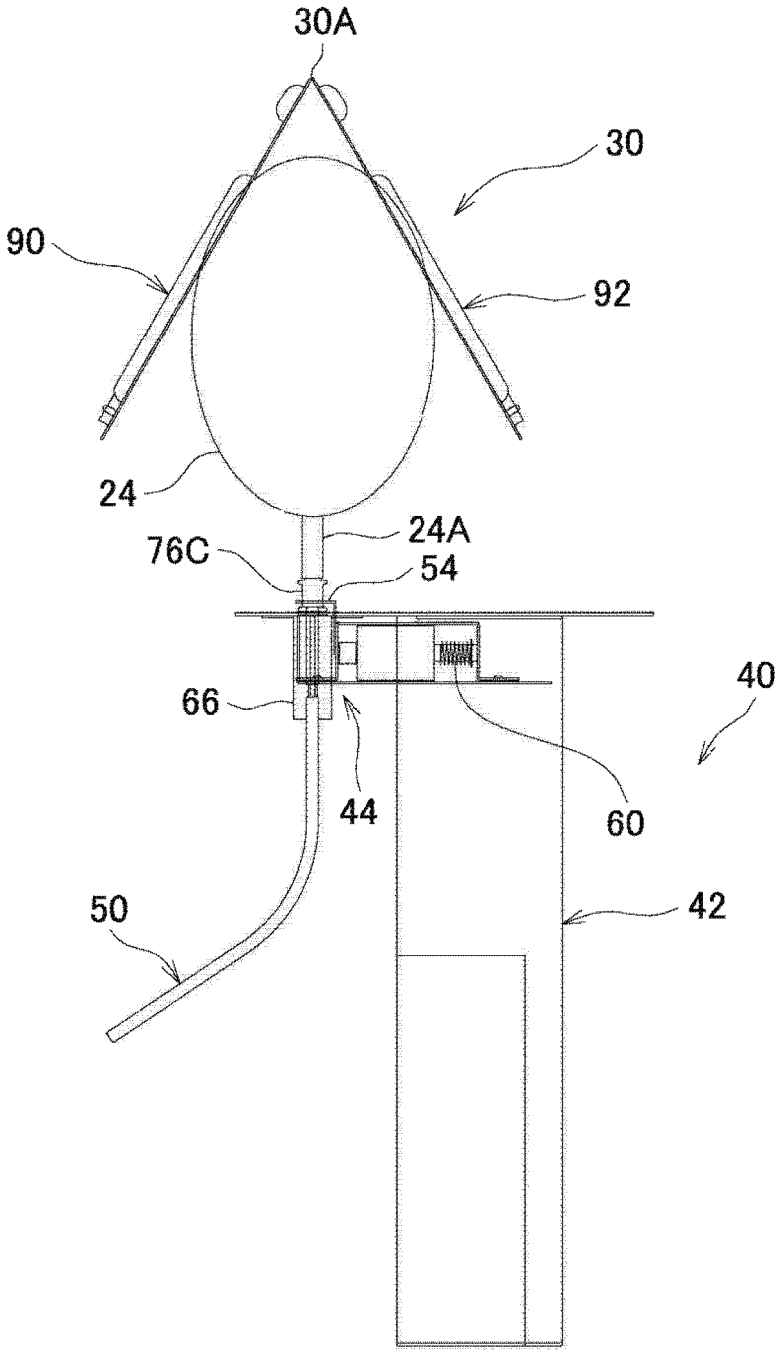
FIG. 8 is a schematic explanatory diagram illustrating the procedure of expanding the balloon body stored in the balloon case by the gas injection device of the balloon vending machine according to the first embodiment.
Figure 9:
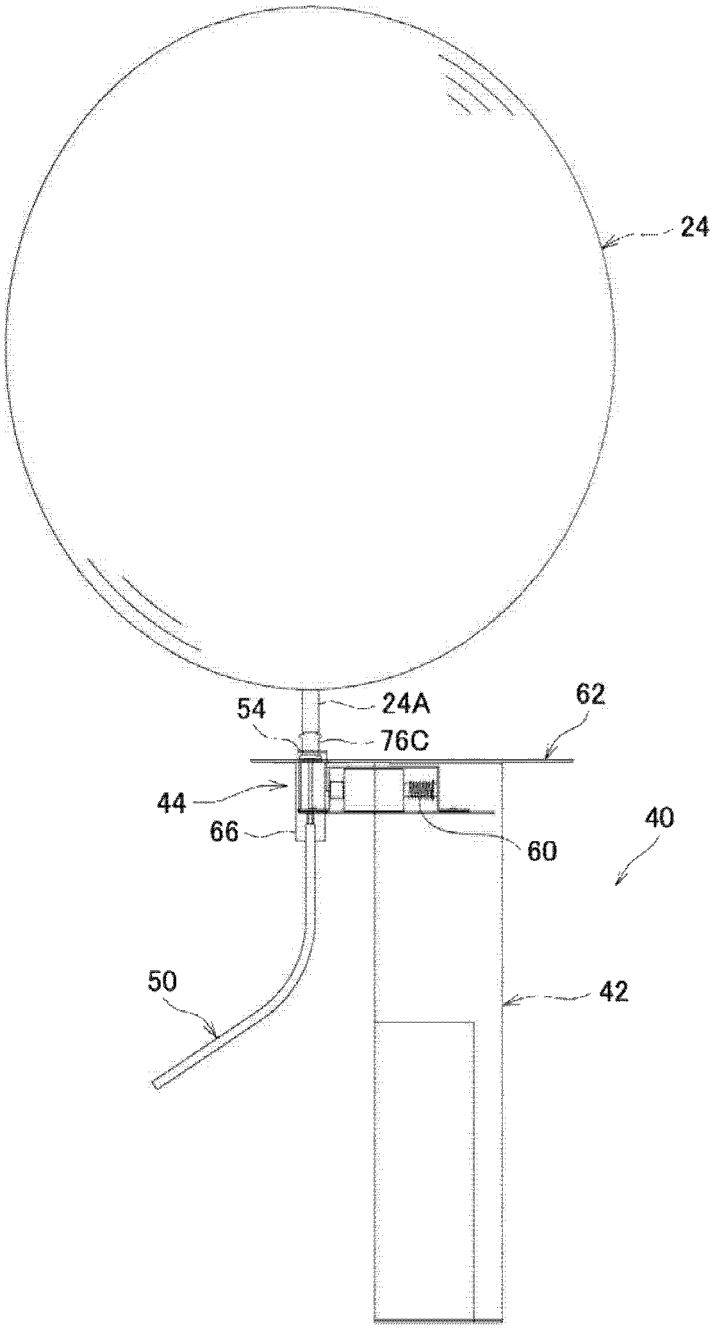
FIG. 9 is a schematic explanatory diagram illustrating the procedure of expanding the balloon body stored in the balloon case by the gas injection device of the balloon vending machine according to the first embodiment.

Further, when the second switch 72 is turned on, the helium gas is injected from the gas hose 50 and the gas injection nozzle 48 into the balloon body 24 to gradually expand the balloon body 24 (refer to FIG. 8 and D state of FIG. 12). Upon expansion of the balloon body 24, since the balloon body 24 presses the first casing piece 90 and the second casing piece 92 of the balloon case 30 in a separation direction from each other, the first part of engagement part 88A and the second part of engagement part 88B come off to release engagement of the casing piece engagement part 88.

With this arrangement, the first casing piece 90 and the second casing piece 92 of the balloon case 30 are opened so as to be broken about the center folding line 30A (refer to FIG. 8 and D state of FIG. 12). Accordingly, the balloon case 30 separates away from the balloon body 24, just like it flies away (refer to E state of FIG. 12). Therefore, the balloon purchaser can observe a state where the balloon body 24 is being expanded and, further, can observe in excitement a state with originality and impact where the balloon case 30 is dynamically broken and flies away from the balloon body 24. Further, since the balloon purchaser observes in excitement the impactful state where the balloon case 30 is dynamically broken and opened, the balloon purchaser does not get bored during the waiting time until the balloon body 24 is expanded.

When a predetermined amount of the helium gas is injected into the balloon body 24 to expand the balloon body 24 in a spherical shape (refer to FIG. 9), the gas injection sensor 51 perceives the state to stop injection of the helium gas. Then, the rotational shaft performs the reverse rotation to start downward movement of the nozzle mover 44. Therefore, a lower end face of the expanded balloon body 24 abuts on the table plate 62, the balloon body 24 cannot move downward and the balloon valve 76 comes out of the gas injection cylinder part 24A of the balloon body 24. With this arrangement, the balloon body 24 rises in the gas injection part 26 due to the helium gas, but it can be prevented from going up high by the roof part 34 of the gas injection part 26 (refer to F state of FIG. 12).

Note that the switch activator 70 of the switch activator mounting plate 68 of the nozzle mover 44 presses the contact part 74A of the third switch 74 to stop the rotation of the rotational shaft and also stop the nozzle mover 44. Therefore, the balloon purchaser closes the first casing piece 90 and the second casing piece 92 that have been opened, fits the first part of engagement part 88A of the balloon case 30 and the second part of engagement part 88B thereof with each other, and puts the finger into the finger inserting part 82 of the balloon case 30 to hold the handle 80.

The balloon purchaser securely holds the balloon case 30 of the balloon 12 as the handle with the hand, and takes the balloon 12 out of the gas injection part 26, and then the door motor performs the reverse rotation to close the door of gas injection part 28. As the result, since the balloon purchaser can securely hold the balloon case 30 as the handle with the hand, the balloon body 24 can be prevented from going up high and flying away in the sky (G state of FIG. 12).

Note that, as to the balloon 12 according to the embodiment, since the balloon case 30 can be reused as the handle when the balloon 12 is held, the balloon case 30 is not discarded as garbage. Further, work and expense can be reduced for installing a garbage box for discarding the balloon case 30 near the balloon vending machine 10.

Note that, according to the embodiment, a blister case is used as the balloon case 30, but the balloon case 30 is of course not limited to the blister case. Further, in the embodiment, the balloon body 24 made of plastic is used. However, the balloon body 24 is not limited to the one made of plastic, and may be, of course, one made of other material such as aluminum. Note that, in the embodiment, the helium gas is used as gas to be filled in the balloon body 24. However the gas to be filled in the balloon body 24 is not of course limited to the helium gas.

Second Embodiment

Configuration of Balloon Vending Machine According to Second Embodiment

In the above-described embodiment, the balloon case inserting port is always opened. However, the insertion part door that can be opened and closed may be provided at the balloon case inserting port. The balloon case inserting port can be opened or closed with the insertion part door so as to prevent mixing-in of foreign matters and improve safety of users. Further, a configuration for further improving tightness of a gas injection nozzle 148 to the balloon valve 76 may be added. By improving the tightness of the gas injection nozzle 148 to the balloon valve 76, it is possible to prevent gas leakage effectively.

Figure 13:
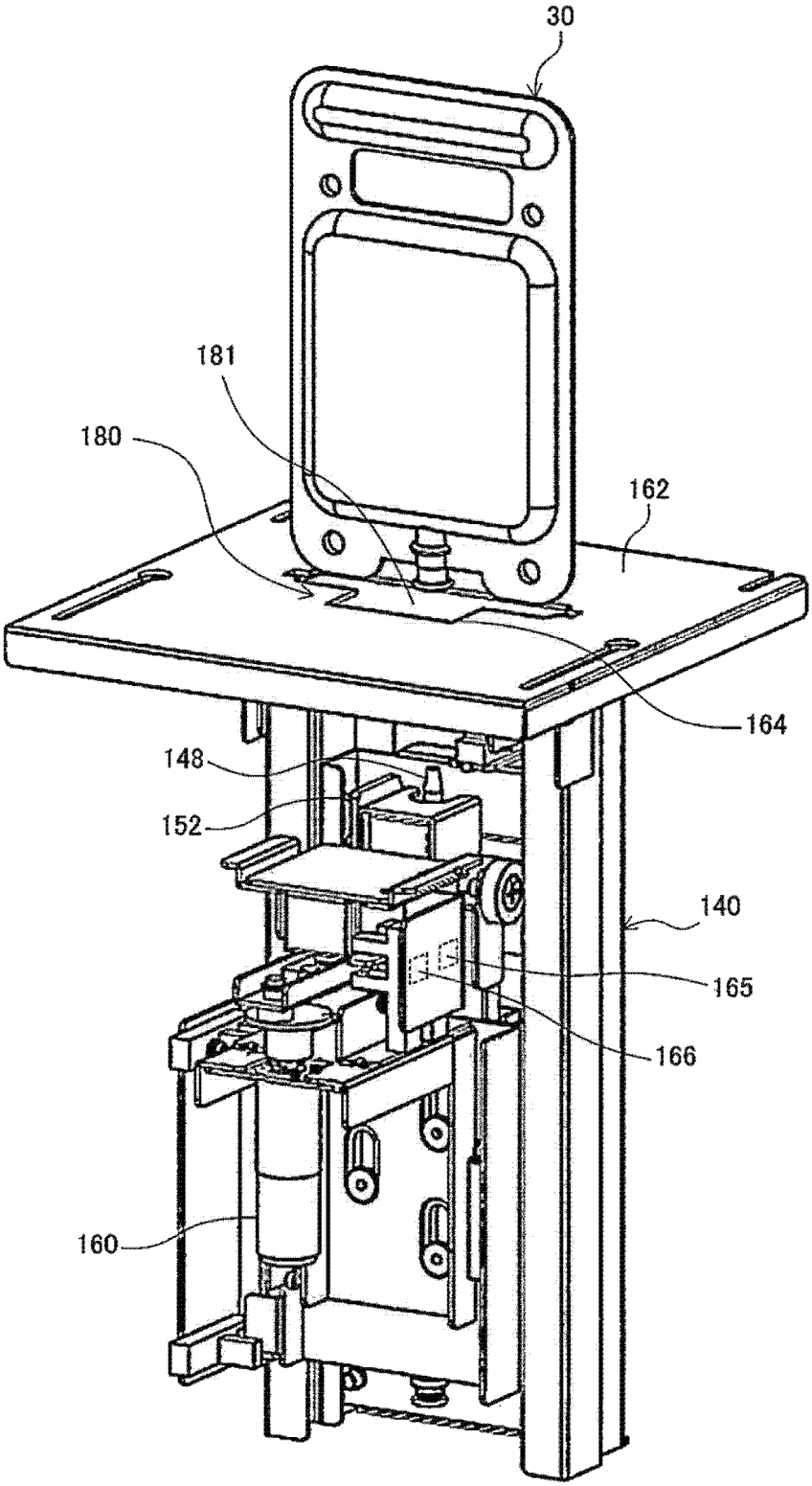
FIG. 13 is a perspective view of a gas injection device of a balloon vending machine according to a second embodiment viewed from above.
Figure 14:
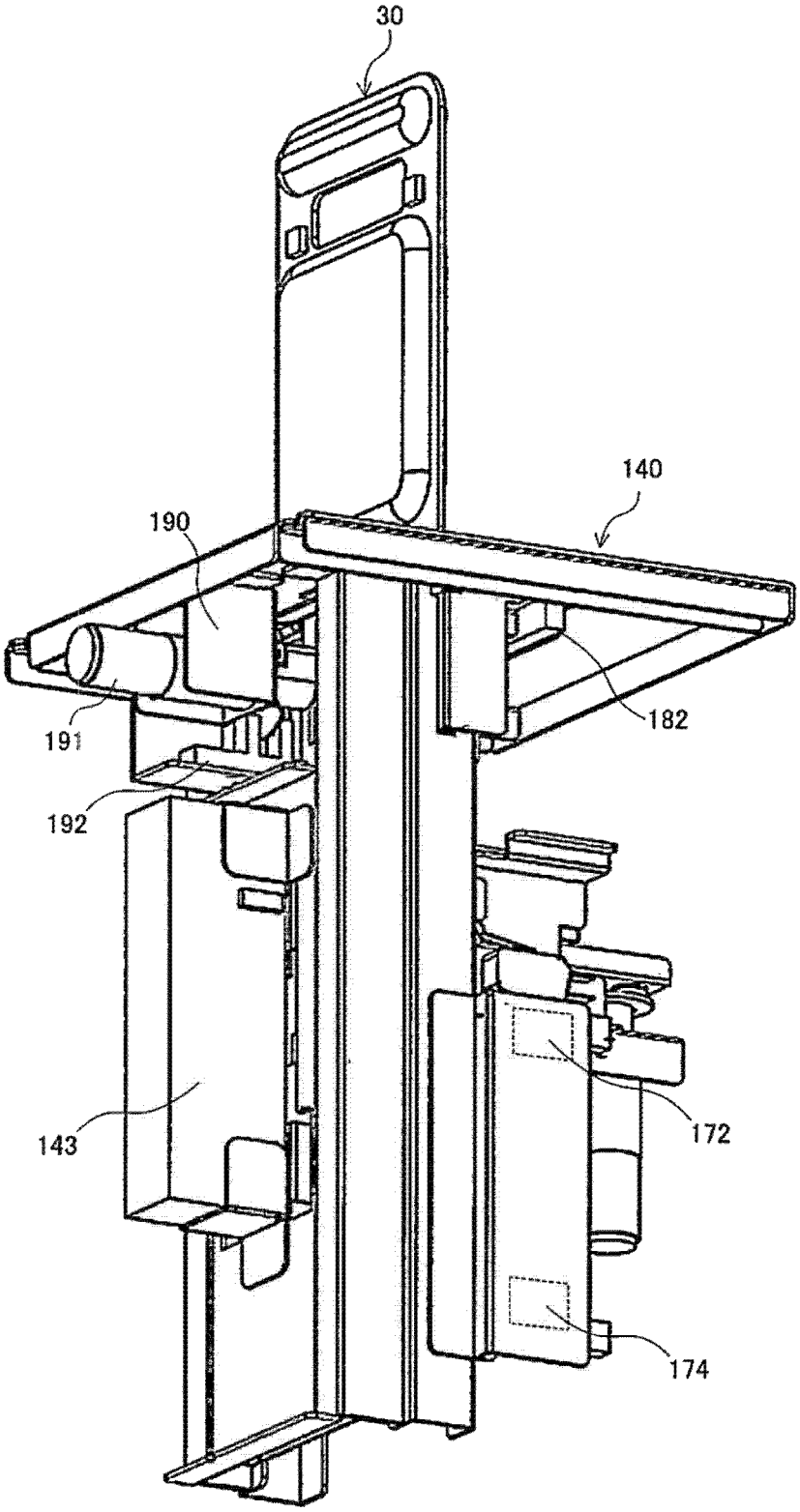
FIG. 14 is a perspective view of the gas injection device of the balloon vending machine according to the second embodiment viewed from below.
Figure 15:
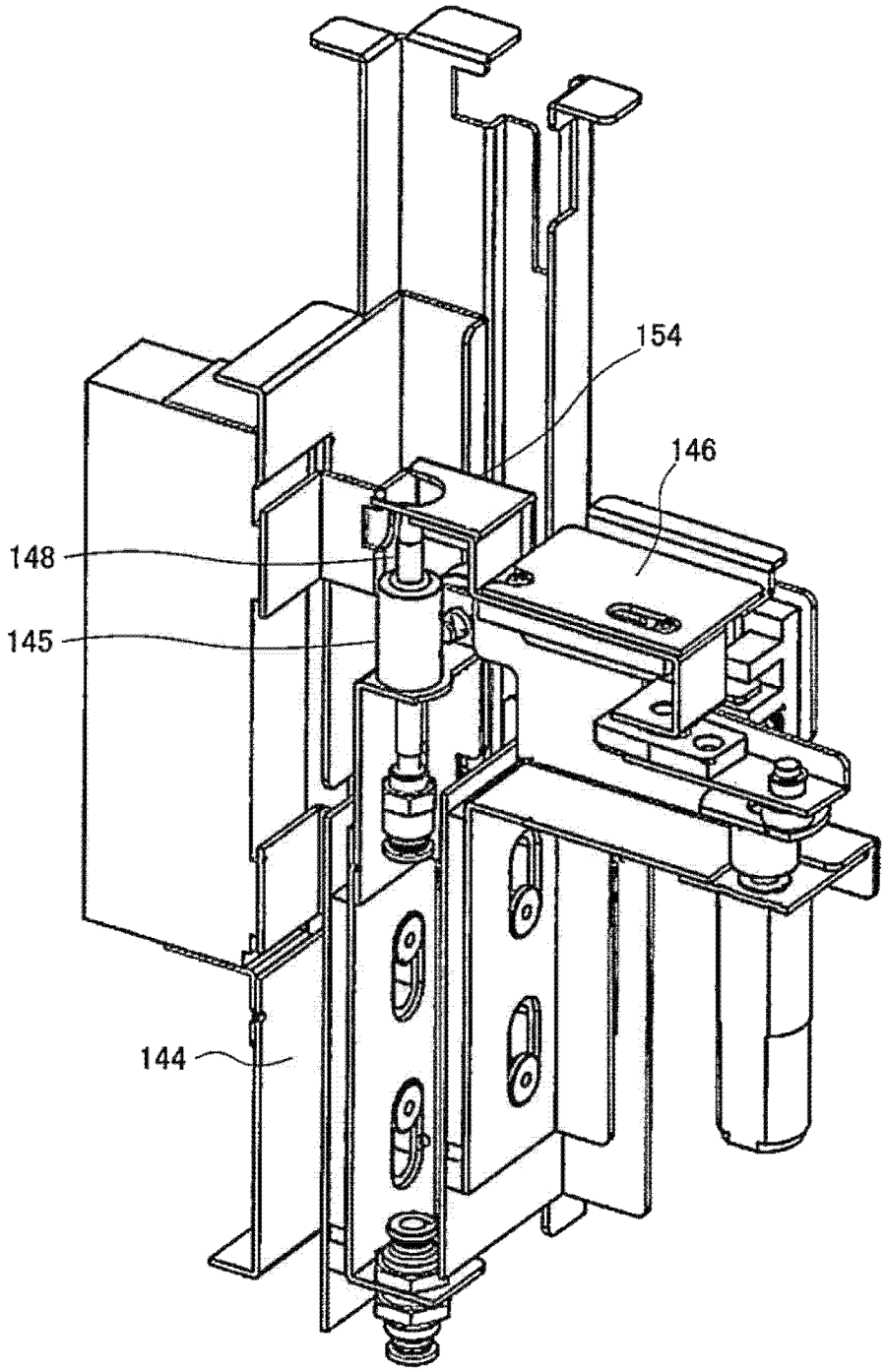
FIG. 15 is a perspective view of each unit of the balloon vending machine according to the second embodiment.

FIGS. 13 to 15 illustrate a part of the balloon vending machine according to the second embodiment. As illustrated in the drawings, a balloon case inserting port 164 of a gas injection device 140 is provided with a unit of insertion part door 180 and a lock unit of insertion part door 190 so that the balloon case inserting port 164 can be opened and closed with the door. The unit of insertion part door 180 includes an insertion part door 181 and a sensor of insertion part door 182. The lock unit of insertion part door 190 includes a lock sensor of insertion part door 192 and a lock motor of insertion part door 191.

A balloon case detection sensor 152 detects that the balloon case 30 has been inserted into the balloon case inserting port 164. A lock mechanism 145 includes a valve lock plate 154, a lock motor 160, a lock start sensor 165, and an unlock sensor 166, to lock the balloon valve 76 via which the gas is injected when the balloon case is inserted into the balloon case inserting port 164.

The lock motor 160 gives a driving force of the motor to the valve lock plate 154 to advance or retreat the valve lock plate 154. The lock start sensor 165 detects that the balloon valve 76 has been locked, and the unlock sensor 166 detects that the balloon valve 76 has been unlocked.

The nozzle mover includes a nozzle mounting part 146 and can move in the vertical direction with a driving force of a slide motor 143. An upper nozzle mover sensor 172 detects that the nozzle mover has been moved upward, while a lower nozzle mover sensor 174 detects that the nozzle mover has been moved downward.

Actions of Balloon Vending Machine According to Second Embodiment and Balloon An action of the balloon vending machine according to the second embodiment having the above-described configuration will be described. First, the insertion part door 181 is opened and the lock motor of insertion part door 191 operates. As a result, the lock sensor of insertion part door 192 is set in an off state to stop the lock motor of insertion part door 191, and then the insertion part door is unlocked. Then, the insertion part door sensor 182 is turned off to be set in a state where the balloon case can be set.

Upon insertion of the balloon case 30 into the balloon case inserting port 164, the balloon case detection sensor 152 is set in the on state. Then, the lock motor 160 operates to move the valve lock plate 154. At this time, the lock start sensor 165 located at a front side of the valve lock plate 154 is turned on, and the unlock sensor 166 located at a back side thereof is turned off. Then, the lock motor 160 is stopped, and thus the balloon case 30 cannot be taken out.

Subsequently, the slide motor 143 operates to raise the lock mechanism 145, the nozzle mounting part 146, and a nozzle mover 144 simultaneously. As a result, the lower nozzle mover sensor 174 is turned off, and the lock mechanism 145 comes into contact with a table plate 162 to be stopped. At this time, since a spring has buffer, the nozzle mounting part 146 and the nozzle mover 144 continue to be raised.

Subsequently, the balloon valve 76 of the balloon case comes into contact with the lock mechanism 145 to be stopped. At this time, since the spring has buffer, the nozzle mover 144 continues to be raised. The nozzle mover 144 is raised to press an O-ring of the gas injection nozzle 148 to the balloon valve 76 of the balloon case to decrease leakage of the gas. When the nozzle mover 144 is raised completely, the upper nozzle mover sensor 172 is set in the on state, and the slide motor 143 is stopped to complete gas injection preparation.

When the gas is injected, the balloon body 24 expands and thus the balloon case 30 is broken. When it is detected that the predetermined amount of gas has been injected, the balloon vending machine stops injection of gas. A gas injection operation is similar to that of the first embodiment.

When the injection of the gas is finished, the balloon valve 76 pressed with the spring is unlocked. When it is unlocked, the slide motor 143 is slightly operated to lower the nozzle mover 144. With this arrangement, the upper nozzle mover sensor 172 is set in the off state, and pressing of the balloon valve 76 is released.

Subsequently the lock motor 160 operates. Then, when the lock start sensor 165 is set in the off state and the unlock sensor 166 is set in the on state, the lock motor 160 is stopped. Furthermore, with the buoyancy of the balloon body 24, the balloon body 24 comes off from the gas injection nozzle 148, and the balloon case detection sensor 152 is set in the off state.

When the balloon body 24 comes off from the gas injection nozzle 148, the insertion part door 181 is automatically closed with the spring. Then, the sensor of insertion part door 182 is set in the on state, and the lock motor of insertion part door 191 operates. When the lock sensor of insertion part door 192 is set in the on state, the lock motor of insertion part door 191 stops to lock the insertion part door. Finally, when the slide motor 143 is operated to further lower the nozzle mover 144, the lower nozzle mover sensor 174 is set in the on state to return to an original state.

REFERENCE SIGNS LIST

10 balloon vending machine
12 balloon
14 balloon stock part
16 storage part for machine body
18 balloon discharging opening
20 coin inserting slot
21 selection determination button
22 balloon sample case part
24 balloon body
26 gas injection part
28 door of gas injection part
30 balloon case
32 display monitor
34 roof part
36 bottom face plate
38 opening of bottom face plate
40 gas injection device
42 casing
44 nozzle mover
46 nozzle mounting part

48 gas injection nozzle
50 gas hose
51 gas injection sensor
52 first switch
54 valve lock plate
56 opening part of lock
60 solenoid
62 table plate
64 balloon case inserting port
66 guide cylinder for balloon case
68 switch activator mounting plate
70 switch activator
72 second switch
74 third switch
76 balloon valve
78 string
80 handle
82 finger inserting part
84 storage part for balloon body
86 valve inserting part
88 casing piece engagement part
90 first casing piece
92 second casing piece
140 gas injection device
143 slide motor
144 nozzle mover
145 lock mechanism
146 nozzle mounting part
148 gas injection nozzle
152 balloon case detection sensor
154 valve lock plate
160 lock motor
162 table plate
164 balloon case inserting port
165 sensor for lock start
166 sensor for unlock
172 upper nozzle mover sensor
174 lower nozzle mover sensor
180 unit of insertion part door
181 insertion part door
182 sensor of insertion part door
190 lock unit of insertion part door
191 lock motor of insertion part door
192 lock sensor of insertion part door

The invention claimed is:

1. A balloon vending machine, which sells a balloon having, a balloon body, a balloon case being closed and storing the balloon body, and a balloon valve connected to the balloon body for gas injection, the balloon valve being fixed and inserted in the closed balloon case, the balloon case being opened with the injection of gas into the balloon valve, the balloon vending machine comprising:

a table plate provided at a front face of a machine body;

a balloon case inserting port formed through the table plate, the balloon case being inserted into the balloon case inserting port, a part of the balloon case being set below the table plate by inserting of the balloon case;

a gas injection nozzle that is disposed below the table plate and is capable of connecting to the balloon valve by vertical movement; and a lock mechanism configured to lock the balloon valve against the vertical movement of the gas injection nozzle, when the balloon case is inserted into the balloon case inserting port;

a control section configured to control movement of the gas injection nozzle and injection of the gas into the balloon body, wherein after the insertion of the balloon case, the control section moves the gas injection nozzle upward, and connects the gas injection nozzle with the balloon valve, the control section moves the balloon case together with the gas injection nozzle upward, the control section starts injection of the gas into the balloon body when having detected that the entire balloon case has been projected upward from the table plate, and the gas injection into the balloon valve causes the balloon body to expand, and the balloon case is broken to be opened.

2. The balloon vending machine according to claim 1, wherein the control section finishes gas injection when gas pressure in the balloon body corresponds to gas pressure of the gas injection.

3. The balloon vending machine according to claim 1, wherein the lock mechanism includes a valve lock plate movable in a front and back direction, and the valve lock plate has a lock opening formed to be capable of locking the balloon valve.

4. A balloon that is to be sold by a balloon vending machine, comprising:

a balloon body that expands by injection of gas;

a balloon case including a first casing piece and a second casing piece, and configured to store the balloon body by joining and closing the first casing piece and the second casing piece; and a balloon valve to be inserted into a gas injection cylinder part of the balloon body; and a string configured to connect the balloon body with the balloon case, wherein the balloon case includes a valve insertion part that fixes the balloon valve through the balloon case when the balloon case is closed with the balloon body stored, and wherein the balloon valve includes a recessed part for engagement, the recessed part for engagement is to be engaged by the balloon vending machine to lock the balloon valve against movement of a gas injection nozzle when the gas is injected to the balloon body that is stored in the closed balloon case, and the recessed part for engagement is formed between two bulging parts in the balloon valve, and a diameter of the recessed part for engagement is smaller than diameters of the bulging parts, wherein the gas injection into the balloon valve causes the balloon body to expand, and the balloon case is broken to be opened, wherein, upon expansion of the balloon body, the balloon body presses the first casing piece and the second casing piece of the balloon case in a separation direction, whereby the first casing piece and the second casing piece of the balloon case are opened so as to be broken about a center folding line, and then the first casing piece and the second casing piece can be closed, and wherein one end of the string is connected to the balloon body, and the other end of the string is connected to an internal face of a balloon storage part of the balloon case storing the balloon body.

5. The balloon according to claim 4, further comprising:

wherein the balloon case includes a handle for gripping.

* * * * *